US011873184B2

(12) United States Patent
Jang et al.

(10) Patent No.: US 11,873,184 B2
(45) Date of Patent: Jan. 16, 2024

(54) MEDIUM CONVEYANCE PATH SWITCHING DEVICE OF AUTOMATED TELLER MACHINE

(71) Applicant: HYOSUNG TNS INC., Seoul (KR)

(72) Inventors: Hyun Soo Jang, Seoul (KR); Hyebin Oh, Seoul (KR)

(73) Assignee: HYOSUNG TNS INC., Seoul (KR)

( * ) Notice: Subject to any disclaimer, the term of this patent is extended or adjusted under 35 U.S.C. 154(b) by 82 days.

(21) Appl. No.: 17/749,579

(22) Filed: May 20, 2022

(65) Prior Publication Data

US 2022/0380155 A1 Dec. 1, 2022

(30) Foreign Application Priority Data

May 28, 2021 (KR) ..... 10-2021-0068984

(51) Int. Cl.
*B65H 5/36* (2006.01)
*B65H 29/58* (2006.01)

(52) U.S. Cl.
CPC ..... *B65H 5/36* (2013.01); *B65H 29/58* (2013.01); *B65H 2301/3125* (2013.01); *B65H 2301/44822* (2013.01); *B65H 2404/632* (2013.01); *B65H 2405/35* (2013.01)

(58) Field of Classification Search
CPC ..... B65H 5/36; B65H 29/58; B65H 29/60; B65H 2404/632; B65H 2301/44822
See application file for complete search history.

(56) References Cited

U.S. PATENT DOCUMENTS

| | | | | |
|---|---|---|---|---|
| 8,695,977 | B2 * | 4/2014 | Nunn | B65H 29/58 271/303 |
| 10,167,161 | B2 * | 1/2019 | Chang | B65H 29/58 |
| 10,377,599 | B2 * | 8/2019 | Chou | B65H 43/04 |
| 11,640,740 | B2 * | 5/2023 | Jang | B65H 43/02 271/303 |

(Continued)

FOREIGN PATENT DOCUMENTS

| | | |
|---|---|---|
| EP | 3 282 429 A1 | 2/2018 |
| KR | 1011738060000 | 8/2012 |

OTHER PUBLICATIONS

1 Extended European Search Report in European Application No. 22175332.0 dated Nov. 2, 2022.

*Primary Examiner* — Patrick Cicchino
(74) *Attorney, Agent, or Firm* — BACON & THOMAS, PLLC

(57) ABSTRACT

A medium conveyance path switching device include: a support unit located at a branch point of a conveyance path at which a conveying direction for a medium converges from three directions; a gate assembly including gates to guide the medium to different conveyance paths at the branch point; and a rotation mechanism configured to selectively rotate the gates. The support unit includes: a first support piece having a first through-hole portion; a second support piece having a second through-hole portion and disposed on one side of the first support piece; a third support piece having a third through-hole portion and disposed on the other side of the first support piece; a first bending connection part pivotably connecting one end of the first support piece and the second support piece; and a second bending connection part pivotably connecting the other end of the first support piece and the third support piece.

5 Claims, 11 Drawing Sheets

(56) References Cited

U.S. PATENT DOCUMENTS

| | | | | |
|---|---|---|---|---|
| 2015/0194004 | A1* | 7/2015 | Sackfield | G07D 11/18<br>194/346 |
| 2022/0204301 | A1* | 6/2022 | Jang | G07D 11/18 |

* cited by examiner

MEDIUM CONVEYANCE PATH SWITCHING DEVICE OF AUTOMATED TELLER MACHINE

TECHNICAL FIELD

The present disclosure relates to a medium conveyance path switching device of an automated teller machine.

BACKGROUND

In general, an automated teller machine (ATM) is a device that allows a user to make deposit/withdrawal of cash or check, account transfer, and balance inquiries without restriction of time using a cash card or passbook issued by a financial institution, and an unmanned terminal widely used in the financial industry due to its rapid processing.

The automated teller machine includes a deposit/withdrawal unit through which a user inputs or receives medium for deposit and withdrawal, a conveyance path through which mediums deposited and withdrawn through the deposit/withdrawal unit is transferred, and an identification provided on the conveyance path to identify whether there is an abnormality in the medium and a type of banknote, a temporary storage unit for temporarily storing the deposited medium after passing through the identification unit, a reject banknote storage unit in which a medium identified as having an abnormality among withdrawal mediums is stored, and a medium storage unit for performing a reflux function so that the medium is accommodated or withdrawn.

In addition, a gate provided in the conveyance path is generally formed in a blade shape which is installed at a location where the conveyance path is branched to be rotatable about a rotary shaft, so that the medium transferred from any one conveyance path in response to the deposit/withdrawal process is transferred to any one conveyance path among the remaining conveyance paths. The conveyance path is provided with a medium conveyance path switching device configured to switch the conveyance path so that the medium is transferred to multi-directional conveyance paths in accordance with the deposit/withdrawal process.

The conventional medium conveyance path switching device is generally formed in a triangular blade shape which is rotatably installed at a location where three-way conveyance paths are branched, so that the medium transferred from any one conveyance path in response to the deposit/withdrawal process is transferred to any one of the remaining two conveyance paths.

However, since the conventional medium conveyance path switching device requires a relatively large installation space for an actuator for driving the blade, it may be difficult to arrange the parts in a space-intensive manner in the device.

In addition, since the conventional medium conveyance path switching device is limited to the conveyance path branching in three directions, it may not be able to actively cope with the increase in the number of branching directions of the conveyance path due to the diversified cassette arrangement.

PRIOR ART DOCUMENT (Patent Document) Korean Patent No. 10-1173806 (published on Aug. 16, 2012)

SUMMARY

In view of the above, the present disclosure provides a medium conveyance path switching device of an automated teller machine, which has a structure that allows medium conveying direction to be accurately and quickly switched when a medium is deposited/withdrawn.

In addition, the present disclosure provide a medium conveyance path switching device of an automated teller machine capable of reducing a medium jam phenomenon by variably adjusting thickness of a bending connection part connecting different support pieces.

In accordance with an embodiment of the present disclosure, there is provided a medium conveyance path switching device of an automated teller machine, including: a support unit located at a branch point of a conveyance path at which a conveying direction for a medium converges from three directions; a gate assembly including a plurality of gates to guide the medium to different conveyance paths at the branch point; and a rotation mechanism configured to selectively rotate the plurality of gates, wherein the support unit includes: a first support piece having a first through-hole portion; a second support piece having a second through-hole portion and disposed on one side of the first support piece; a third support piece having a third through-hole portion and disposed on the other side of the first support piece; a first bending connection part pivotably connecting one end of the first support piece and the second support piece; and a second bending connection part pivotably connecting the other end of the first support piece and the third support piece, and wherein the first bending connection part has different thicknesses in a direction connecting the one end of the first support piece and the second support piece, and the second bending connection parts have different thicknesses in a direction connecting the other end of the first support piece and the third support piece.

The first bending connection part may include, on an inner surface thereof, a first main convex surface convexly rounded toward an inside direction of the first bending connection part, and a first sub-concave surface concavely recessed with respect to the inner surface of the first bending connection part, the first sub-concave surface continuously extending from the first main convex surface to inner surfaces of the first support piece and the second support piece. The inner surface of the second bending connection part may include, on an inner surface thereof, a second main convex surface convexly rounded toward an inside direction of the second bending connection part, and a second sub-concave surface concavely recessed with respect to the inner surface of the second bending connection part, the second sub-concave surface continuously extending from in the second main convex surface to the inner surface of the first support piece and an inner surface of the third support piece.

The first bending connection part may include, on an inner surface thereof, a first bending concave surface concavely recessed with respect to the inner surface of the first bending connection part and extending continuously to inner surfaces of the first support piece and the second support piece, and the second bending connection part may include, on an inner surface thereof, a second bending concave surface concavely recessed with respect to the inner surface of the second bending connection part and extending continuously to the inner surface of the first support piece and an inner surface of the third support piece.

The plurality of gates may include: a first gate for guiding a conveying direction of the medium from a first conveyance path to a second conveyance path or a third conveyance path in the conveyance path; a second gate for guiding a conveying direction of the medium from the second conveyance path to the first conveyance path or the third conveyance path; and a third gate for guiding a conveying direction of the medium from the third conveyance path to the first conveyance path or the second conveyance path.

At least one of the first bending connection part and the second bending connection part may include a flexible material.

According to one embodiment of the present disclosure, since three support pieces are connected to each other as one unit through the bending connection part, assemblability of the conveyance path switching device can be improved, and the conveying direction of the medium can be accurately and quickly changed when a medium is deposited/withdrawn.

In addition, according to one embodiment of the present disclosure, the bending connection part connecting the different support pieces is formed to have a recessed central portion of a thin thickness, and when the bending connection part is folded, the central portion of the bending connection part becomes sharp and both end portions of the bending connection part become smooth, which enables an angle of incidence of the entering medium (paper sheet) to be small.

Further, according to one embodiments of the present disclosure, the bending connection part connecting the different support pieces is formed thin to have a thick central portion and recessed end portions, and the bend at the both end portions of the bending connection part is large such that the central portion is depressed smoothly, which enables to reduce the medium jam phenomenon.

Furthermore, according to one embodiment of the present disclosure, since a multipurpose product can be produced by changing only the thickness of a part, e.g., the bending connection part of the mold, the cost of the mold can be reduced.

DETAILED DESCRIPTION

Hereinafter, a preferred embodiment of the present disclosure for implementing the spirit of the present disclosure will be described in more detail with reference to the accompanying drawings.

However, in describing the present disclosure, detailed descriptions of known configurations or functions may be omitted to clarify the present disclosure.

When an element is referred to as being 'connected' to, 'supported' by, or 'accessed' by another element, it should be understood that the element may be directly connected to, supported by, or accessed by the other element, but that other elements may exist in the middle.

The terms used in the present disclosure are only used for describing specific embodiments, and are not intended to limit the present disclosure. Singular expressions include plural expressions unless the context clearly indicates otherwise.

Terms including ordinal numbers, such as first and second, may be used for describing various elements, but the corresponding elements are not limited by these terms. These terms are only used for the purpose of distinguishing one element from another element.

In the present specification, it is to be understood that the terms such as "including" are intended to indicate the existence of the certain features, areas, integers, steps, actions, elements and/or combinations thereof disclosed in the specification, and are not intended to preclude the possibility that one or more other certain features, areas, integers, steps, actions, elements and/or combinations thereof may exist or may be added.

Furthermore, in the present disclosure, it is to be noted that expressions, such as the upper side and the lower side, are described based on the illustration of drawings, but may be modified if directions of corresponding objects are changed.

Hereinafter, a detailed configuration of a medium conveyance path switching device of an automated teller machine according to one embodiment of the present disclosure will be described with reference to FIGS. 1 to 11.

Figure 1:
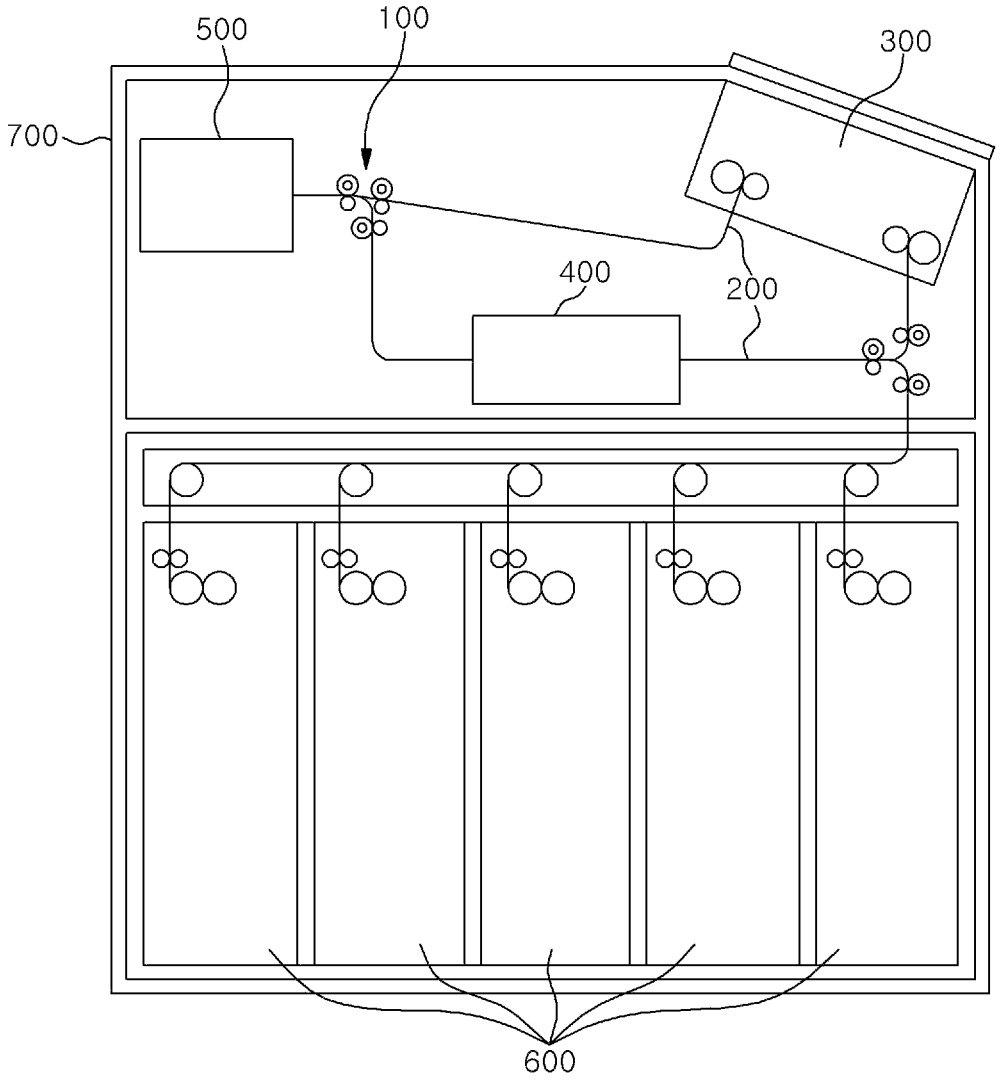
FIG. 1 is a block diagram schematically illustrating an automated teller machine in which a medium conveyance path switching device according to one embodiment of the present disclosure is installed.
Figure 2:
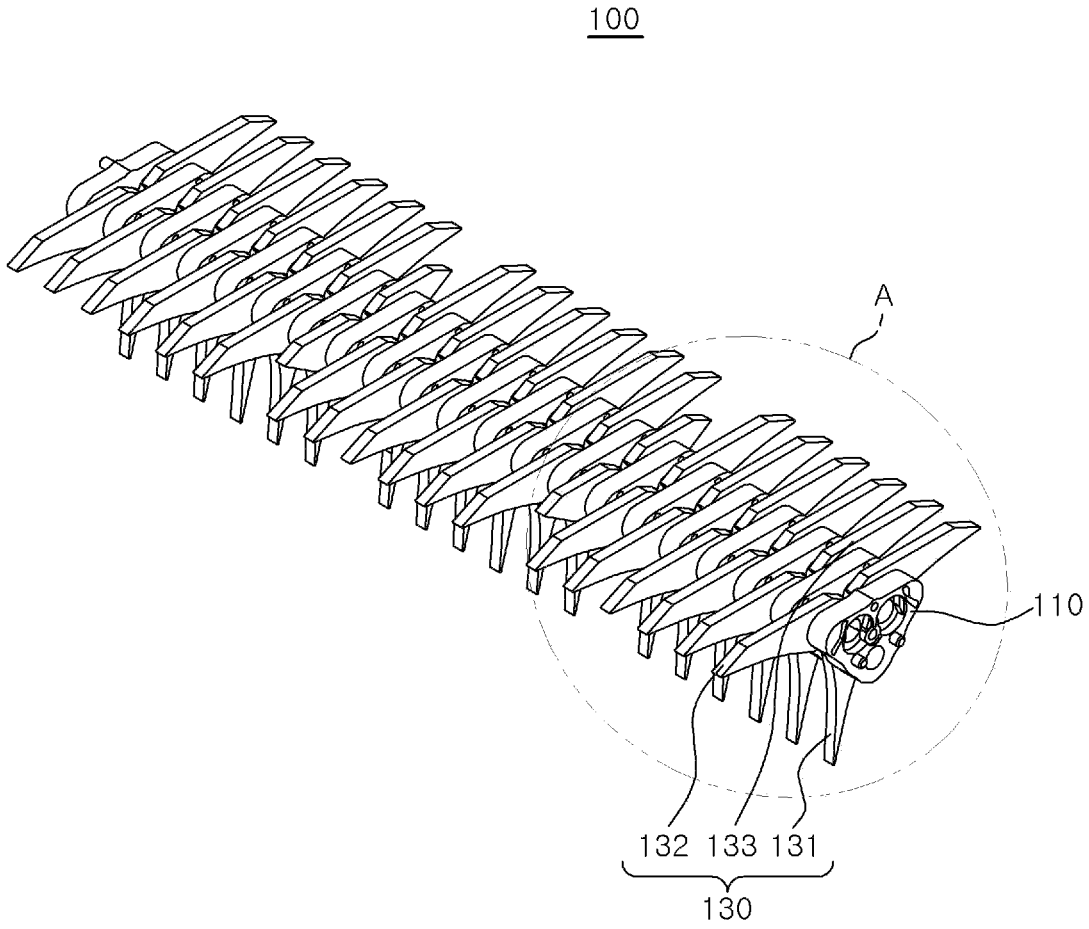
FIG. 2 is a perspective view illustrating the medium conveyance path switching device according to one embodiment of the present disclosure.
Figure 3:
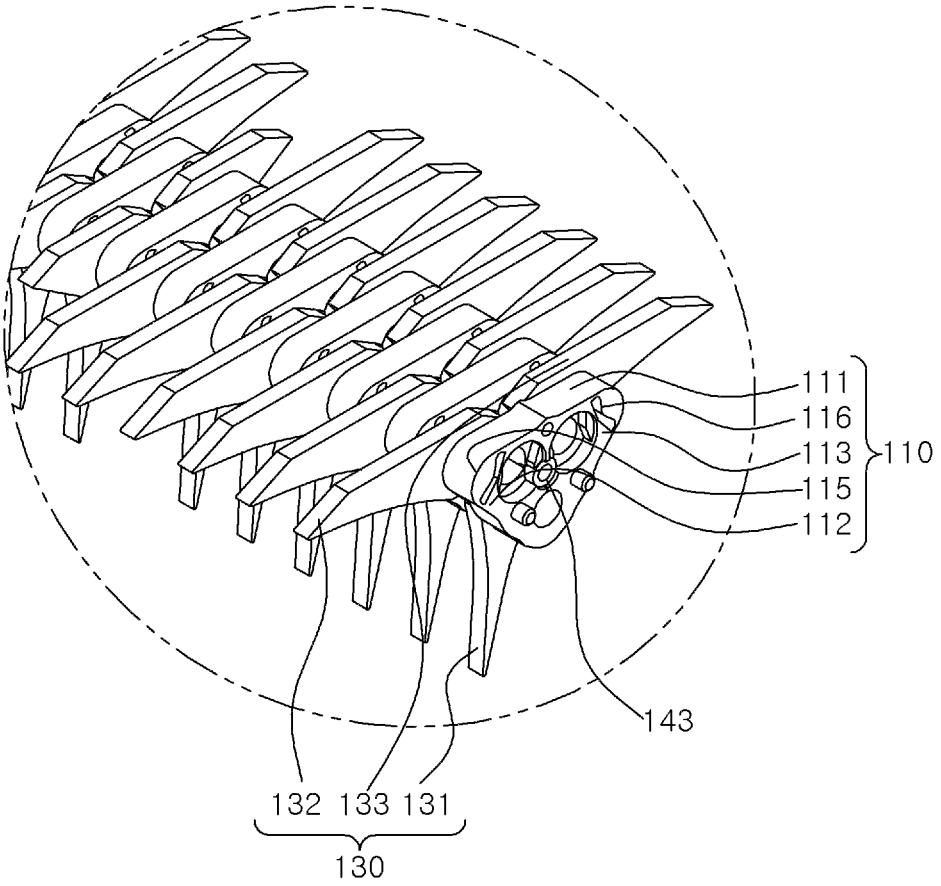
FIG. 3 is an enlarged perspective view illustrating section "A" of FIG. 2.
Figure 4:
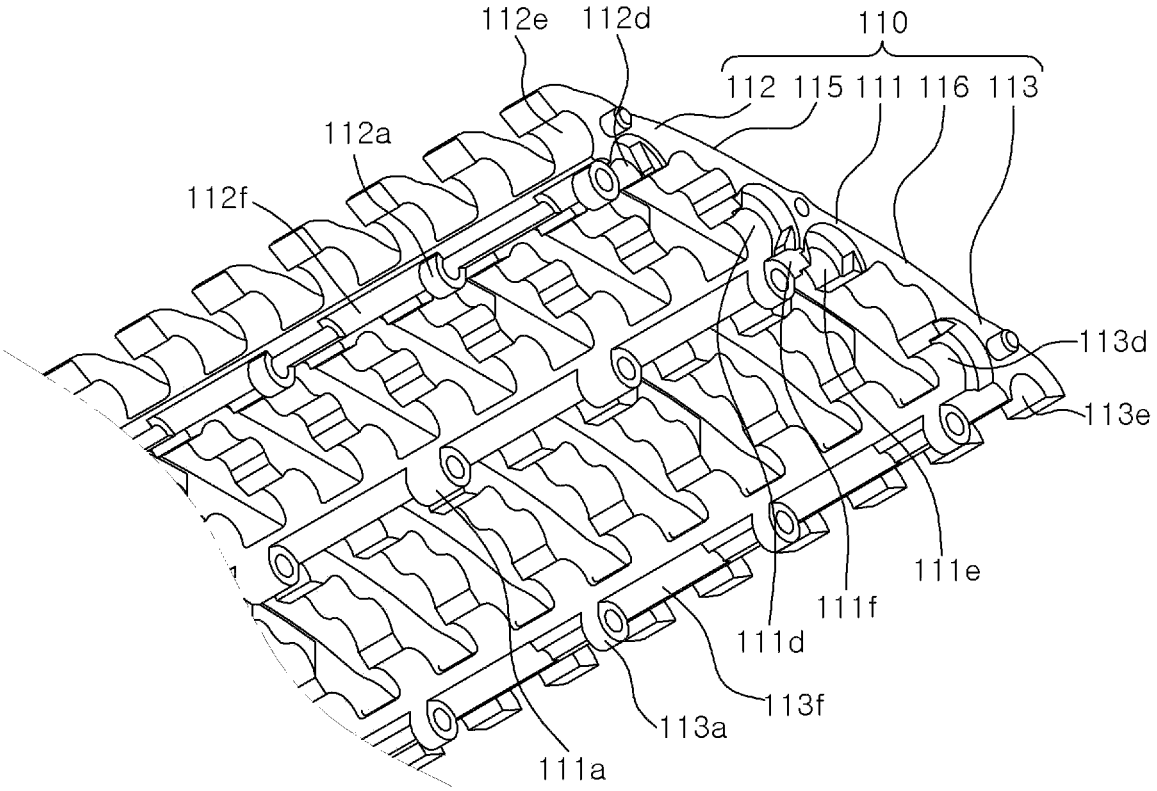
FIG. 4 is a perspective view illustrating a rear side state of a support unit of the medium conveyance path switching device according to one embodiment of the present disclosure before assembly.
Figure 5:
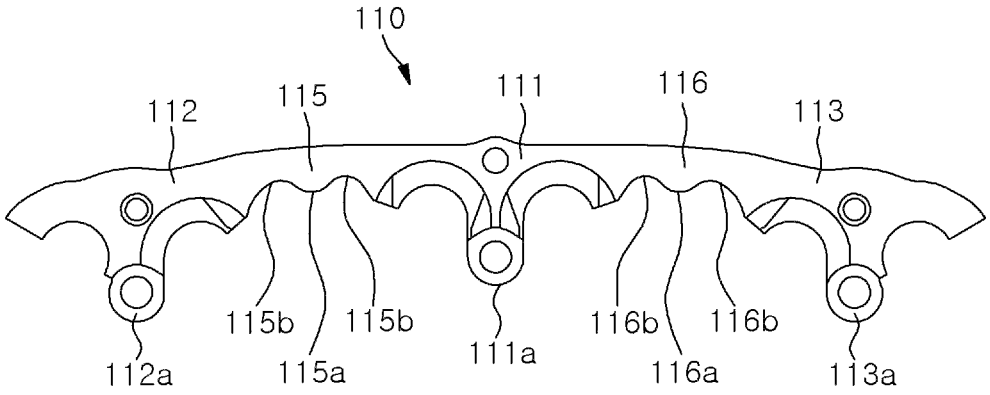
FIG. 5 is a front view illustrating the rear side state of the support unit of the medium conveyance path switching device according to one embodiment of the present disclosure before assembly.
Figure 6:
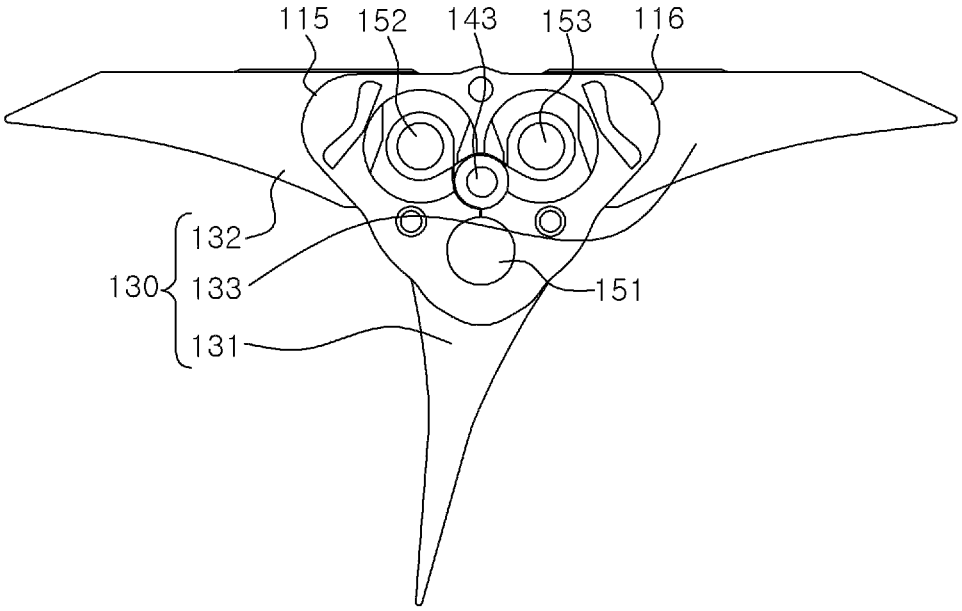
FIG. 6 is a front view illustrating the medium conveyance path switching device of the automated teller machine according to one embodiment of the present disclosure.

As illustrated in FIG. 1, the automated teller machine according to one embodiment of the present disclosure may include a frame/housing 700, a deposit/withdrawal unit 300, a conveyance path 200, a medium conveyance path switching device 100, an identification unit 400, a temporary holding unit 500, and a reflux cassette 600.

The frame/housing 700 may provide a storage space for storing mediums. In the present disclosure, the frame/housing 700 is not limited to a storage space for the mediums (papers, checks, etc.), and the frame/housing 700 may provide an overall appearance of the automated teller machine.

The deposit/withdrawal unit 300 may provide a deposit/withdrawal space for inputting or receiving a medium. The deposit/withdrawal unit 300 may be provided with a belt, a roller, a motor, and the like for transferring a medium. Since the configurations of the belt, the roller, the motor, and the like are general matters in conveying a medium, a detailed description thereof will be omitted.

The conveyance path 200 may provide a conveyance path of a medium in an inner space of the frame/housing 700. Specifically, the conveyance path 200 may provide a conveyance path of a medium that is deposited or withdrawn through the deposit/withdrawal unit 300. For example, the conveyance path 200 may guide the medium deposited through the deposit/withdrawal unit 300 to the identification unit 400, the temporary holding unit 500, and the reflux cassette 600 through the conveyance path, or guide the medium discharged from the reflux cassette 600 to the identification unit 400 and the deposit/withdrawal unit 300 through the conveyance path.

The medium conveyance path switching device 100 may be installed on the conveyance path 200. The medium conveyance path switching device 100 may branch the conveyance path to guide the moving direction of the medium. A detailed description of the medium conveyance path switching device 100 will be described later.

The identification unit 400 may be installed on the conveyance path 200. The identification unit 400 may identify types of mediums passing through the conveyance path 200 and whether there is an abnormality in the mediums. When the deposited mediums are counted, the normal medium identified as a medium having no abnormality by the identification unit 400 may be temporarily accommodated in the temporary holding unit 500, and the suspected medium identified as having an abnormality by the identification unit 400 may be returned to a customer through the deposit/withdrawal unit 300.

The temporary holding unit 500 may provide a storage space for temporarily accommodating the medium identified by the identification unit 400. The temporary holding unit 500 may receive the medium identified through the identification unit 400 through the conveyance path 200.

The reflux cassette 600 may provide a stack space for storing deposited mediums. The reflux cassette 600 may discharge the medium stored in the stack space at the time of withdrawal. The reflux cassette 600 may include a plurality of cassettes having different sizes depending on the types of banknotes.

The configuration of the automated teller machine described above is illustrated to help understanding of the present embodiment. Accordingly, other components may be added thereto as necessary, and the configuration and structure may be modified and changed as needed.

As shown in FIGS. 2 to 6, the medium conveyance path switching device 100 according to one embodiment of the present disclosure may include a support unit 110, a gate assembly 130, and a rotating mechanism.

Figure 9:
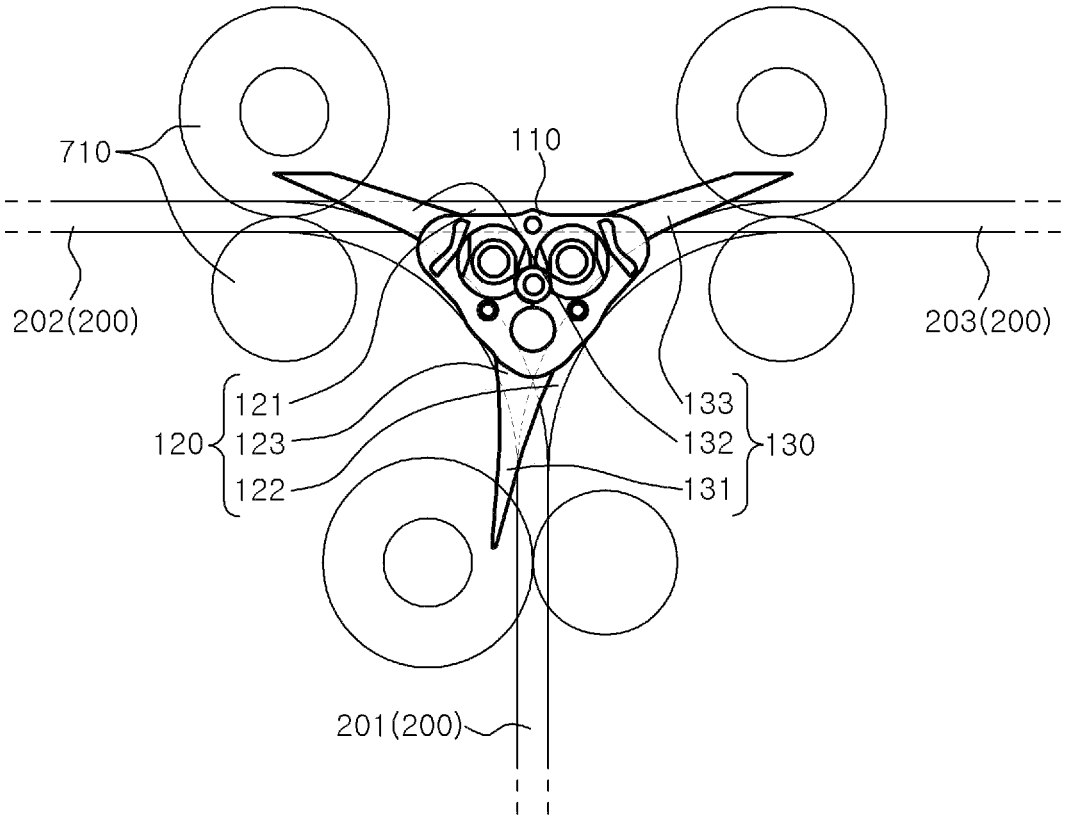
FIGS. 9 to 11 are operation state diagrams illustrating an operation state of the medium conveyance path switching device at a branch point of a conveyance path.

Specifically, the support unit 110 may be located at a branch point of the conveyance path 200 where the conveyance path for the medium converges from three directions. The medium transferred through the conveyance path 200 may be supported by guide rollers 710 (see FIGS. 9 to 11). In the case of the three-way conveyance path 200, for convenience and understanding of the description, the conveyance path located at the lower side in FIG. 9 is defined as a first conveyance path 201, the conveyance path located at the left side in FIG. 9 is defined as a second conveyance path 202, and the conveyance path located at the right side in FIG. 9 is defined as a third conveyance path 203. The support unit 110 may be located at a point where the conveyance path branches to a switching path 120 (see FIGS. 9 to 11).

The support unit 110 may include a first support piece 111, a second support piece 112, a third support piece 113, a fixed shaft 143, a first bending connection part 115, and a second bending connection part 116.

The first support piece 111 may be pivotably connected to the second support piece 112 and the third support piece 113. For example, one end of the first support piece 111 may be pivotably connected to the second support piece 112 through the first bending connection part 115, and the other end of the first support piece 111 may be pivotably connected to the third support piece 113 through the second bending connection part 116.

The first bending connection part 115 and the second bending connection part 116 may be bent without being folded or notched to pivot the second support piece 112 and the third support piece 113 with respect to the first support piece 111. The first bending connection part 115 and the second bending connection part 116 may include a flexible material that can be bent without being folded or notched. In addition, the first support piece 111, the second support piece 112, and the third support piece 113 may be integrally formed, and the first bending connection part 115 and the second bending connection part 116 may also be integrally formed with the first support piece 111, the second support piece 112, and the third support piece 113.

Both side walls of the first support piece 111 may be in close contact with a side wall of the second support piece 112 and a side wall of the third support piece 113. A first through-hole portion 111*a* may be formed at a lower edge of the first support piece 111. When assembling the support unit 110, the fixed shaft 143 may be inserted into and fixed to the first through-hole portion 111*a* of the first support piece 111 in a state where the first support piece 111 is in close contact with the second support piece 112 and the third support piece 113.

The first support piece 111 may include a first one-side shaft groove 111*d* supporting at least a portion of a second rotary shaft 152, a first other-side shaft groove 111*e* supporting at least a portion of a third rotary shaft 153, and a first fixed shaft groove 111*f* supporting at least a portion of the fixed shaft 143.

The second support piece 112 may be connected to the first support piece 111 through the first bending connection part 115 so as to be bendable without being folded or notched. When assembling the support unit 110, the second support piece 112 may be folded toward the first support piece 111 with respect to the first bending connection part 115 and may be in close contact with the sidewall of the first support piece 111.

Both side portions of the second support piece 112 may be in close contact with the sidewall of the first support piece 111 and the sidewall of the third support piece 113. A second through-hole portion 112*a* may be formed at a side edge portion of the second support piece 112. When assembling the support unit 110, the fixed shaft 143 may be inserted into and fixed to the second through-hole portion 112*a* of the second support piece 112 in a state where the second support piece 112 is in close contact with the first support piece 111 and the third support piece 113.

The second support piece 112 may include a second one-side shaft groove 112*d* supporting at least a portion of the second rotary shaft 152, a second other-side shaft groove 112*e* supporting at least a portion of a first rotary shaft 151, and a second fixed shaft groove 112*f* supporting at least a portion of the fixed shaft 143.

The third support piece 113 may be connected to the first support piece 111 through the second bending connection part 116 so as to be bendable without being folded or notched. When assembling the support unit 110, the third support piece 113 is folded toward the first support piece 111 with respect to the second bending connection part 116 without being folded or notched and may be in close contact with the sidewall of the first support piece 111.

Both side portions of the third support piece 113 may be in close contact with the sidewall of the second support piece 112 and the sidewall of the first support piece 111. A third through-hole portion 113*a* may be formed at a side edge portion of the third support piece 113. When assembling the support unit 110, in a state in which the third support piece 113 is in close contact with the first support piece 111 and the second support piece 112, a fixed shaft 143 may be inserted into and fixed to the third through-hole portion 113*a* of the third support piece 113.

In addition, the third support piece 113 may include a third one-side shaft groove 113*d* supporting at least a portion of the third rotary shaft 153, a third other-side shaft groove 113*e* supporting at least a portion of the first rotary shaft 151, and a third fixed shaft groove 113*f* supporting at least a portion of the fixed shaft 143.

The first support piece 111, the second support piece 112, and the third support piece 113 may be disposed symmetrically with respect to the fixed shaft 143.

The fixed shaft 143 may be inserted through the first through-hole portion 111*a*, the second through-hole portion 112*a*, and the third through-hole portion 113*a* in a state where the first support piece 111, the second support piece 112, and the third support piece 113 are in close contact with each other. The fixed shaft 143 may fix the first through-hole portion 111*a*, the second through-hole portion 112*a*, and the third through-hole portion 113*a* to prevent the first support piece 111, the second support piece 112, and the third support piece 113 from being separated from each other. The first through-hole portion 111*a*, the second through-hole portion 112*a*, and the third through-hole portion 113*a* may be alternately disposed by a predetermined rule. For example, the first through-hole portion 111*a*, the second through-hole portion 112*a*, and the third through-hole portion 113*a* may be alternately disposed in the order of the first through-hole portion 111*a*, the second through-hole portion 112*a*, and the third through-hole portion 113*a*.

The first bending connection part 115 may connect the first support piece 111 and the second support piece 112 to be bendable without being folded and notched. The first bending connection part 115 may include a typical soft material which is bendable at a predetermined angle.

The first bending connection part 115 may have different thicknesses in a direction connecting one end of the first support piece 111 and the second support piece 112. For example, a first main convex surface 115*a* and a first sub-concave surface 115*b* may be formed on an inner surface of the first bending connection part 115. The first main convex surface 115*a* may be positioned at a central portion of the first bending connection part 115, and the first sub-concave surface 115*b* may be positioned at both end sides of the first bending connection part 115 with the first main convex surface 115*a* interposed therebetween.

The first main convex surface 115*a* may be rounded convexly at the central portion of the first bending connection part 115 toward an inside direction of the first bending connection part 115. The first sub-concave surface 115*b* may continuously extend from the first main convex surface 115*a* to the inner surfaces of the first support piece 111 and the second support piece 112. The first sub-concave surface 115*b* may be concavely recessed from both ends of the first main convex surface 115*a* with respect to the inner surface of the first bending connection part 115.

The second bending connection part 116 may connect the first support piece 111 and the third support piece 113 to be bendable without being folded and notched. The second bending connection part 116 may include a typical soft material which is bendable at a predetermined angle without being folded and notched.

The second bending connection part 116 may have different thicknesses in a direction connecting the other end of the first support piece 111 and the third support piece 113. For example, a second main convex surface 116*a* and a second sub-concave surface 116*b* may be formed on an inner surface of the second bending connection part 116. The second main convex surface 116*a* may be positioned at the center of the second bending connection part 116, and the second sub-concave surface 116*b* may be positioned at both end sides of the second bending connection part 116 with the second main convex surface 116*a* interposed therebetween.

The second main convex surface 116*a* may be formed to be rounded convexly toward an inside direction of the second bending connection part 116. The second sub-concave surface 116*b* may extend continuously from the second main convex surface 116*a* to the inner surfaces of the first support piece 111 and the third support piece 113. The second sub-concave surface 116*b* may be concavely recessed from both ends of the second main convex surface 116*a* with respect to the inner surface of the second bending connection part 116.

In this way, since each of the first bending connection part 115 and the second bending connection part 116 has a thick central portion and thin end portions that are concave, bending at both ends of the first bending connection part 115 and the second bending connection part 116 is made smooth, which can reduce a medium jam phenomenon.

The gate assembly 130 may guide the moving direction of the medium transferred in the three-way conveyance path. To this end, the gate assembly 130 may include a plurality of gates rotatably installed on the support unit 110. One end of the gate rotates at the point where the conveyance path branches to the switching path 120, and the other end of the gate may selectively open or block the switching path 120.

The gate assembly 130 may include a first gate 131, a second gate 132, and a third gate 133 respectively positioned at the sides of the first conveyance path 201, the second conveyance path 202, and the third conveyance path 203.

The first gate 131 may guide the conveying direction of the medium from the first conveyance path 201 to the second conveyance path 202 or the third conveyance path 203. The first gate 131 may include the first rotary shaft 151 rotatably mounted to the support unit 110 and a plurality of first gate pieces arranged on one side of the first rotary shaft 151 to be spaced apart from each other in a longitudinal direction thereof. The first rotary shaft 151 is a rotary shaft of the first gate 131 and may be rotatably installed at a lower side portion of the support unit 110.

The second gate 132 may guide the conveying direction of the medium from the second conveyance path 202 to the first conveyance path 201 or the third conveyance path 203. The second gate 132 may include the second rotary shaft 152 rotatably mounted to the support unit 110 and a plurality of second gate pieces arranged on one side of the second rotary shaft 152 to be spaced apart from each other in a longitudinal direction thereof. The second rotary shaft 152 is a rotary shaft of the second gate 132 and may be rotatably installed at one side portion of the support unit 110.

The third gate 133 may guide the conveying direction of the medium from the third conveyance path 203 to the first conveyance path 201 or the second conveyance path 202. The third gate 133 may include the third rotary shaft 153 rotatably mounted to the support unit 110 and a plurality of third gate pieces arranged on one side of the third rotary shaft 153 to be spaced apart from each other in a longitudinal direction thereof. The third rotary shaft 153 is a rotary shaft of the third gate 133 and may be rotatably installed at the other side portion of the support unit 110.

The rotation mechanism may include a driving shaft of an actuator connected to at least one of the first rotary shaft 151, the second rotary shaft 152, and the third rotary shaft 153, and a transmission gear (not shown) for transferring a driving force of the actuator to the other rotary shafts.

For example, in case that the first rotary shaft 151 is connected to the driving shaft of the actuator, the second rotary shaft 152 and the third rotary shaft 153 may be connected to the first rotary shaft 151 through the transmission gear (e.g., a drive gear, a driven gear, and the like) to receive the driving force of the actuator through the first rotary shaft 151.

Figure 7:
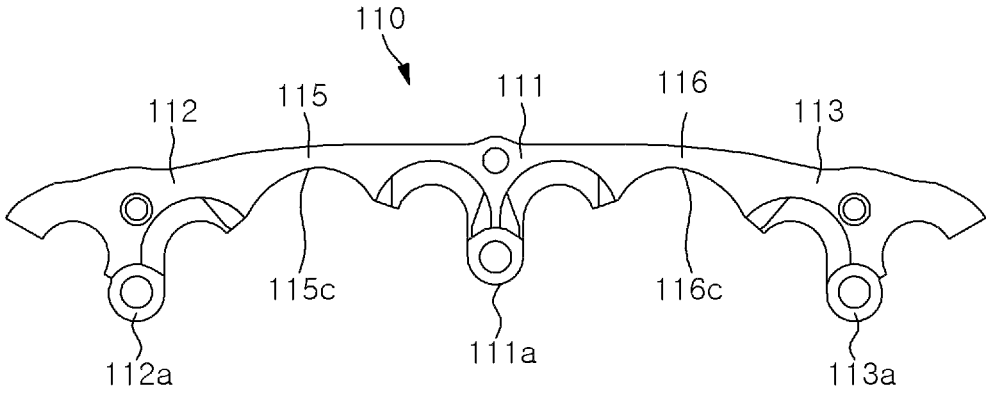
FIG. 7 is a front view illustrating a rear side state of a support unit before assembly of a medium conveyance path switching device according to another embodiment of the present disclosure.
Figure 8:
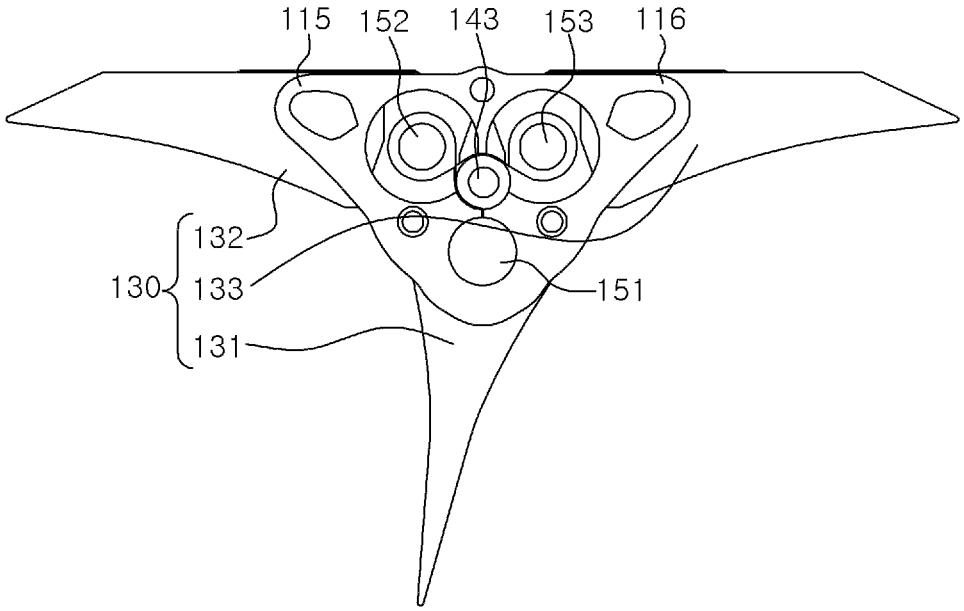
FIG. 8 is a front view illustrating the medium conveyance path switching device of the automated teller machine according to another embodiment of the present disclosure.

Meanwhile, as shown in FIGS. 7 and 8, in a medium conveyance path switching device 100 according to another embodiment of the present disclosure, the first bending connection part 115 may include a first bending concave surface 115*c*, and the second bending connection part 116 may include a second bending concave surface 116*c*.

The first bending concave surface 115*c* of the first bending connection part 115 may be concavely recessed with respect to the inner surface of the first bending connection part 115. The first bending concave surface 115*c* may extend continuously with the inner surfaces of the first support piece 111 and the second support piece 112.

The second bending concave surface 116*c* of the second bending connection part 116 may be concavely recessed with respect to the inner surface of the second bending connection part 116. The second bending concave surface 116*c* may extend continuously with the inner surfaces of the first support piece 111 and the third support piece 113.

In this way, as each of the first bending connection part 115 and the second bending connection part 116 has a thin central portion, when the first bending connection part 115 and the second bending connection part 116 are folded, the centers of the first bending connection part 115 and the second bending connection part 116 may become sharp and both end portions of the first bending connection part 115 and the second bending connection part 116 may be made smooth, which enables an angle of incidence of the entering medium (paper sheet) to be small.

Hereinafter, an operation of the medium conveyance path switching device according to the embodiments of the present disclosure having the above-described configuration will be described.

Figure 10:
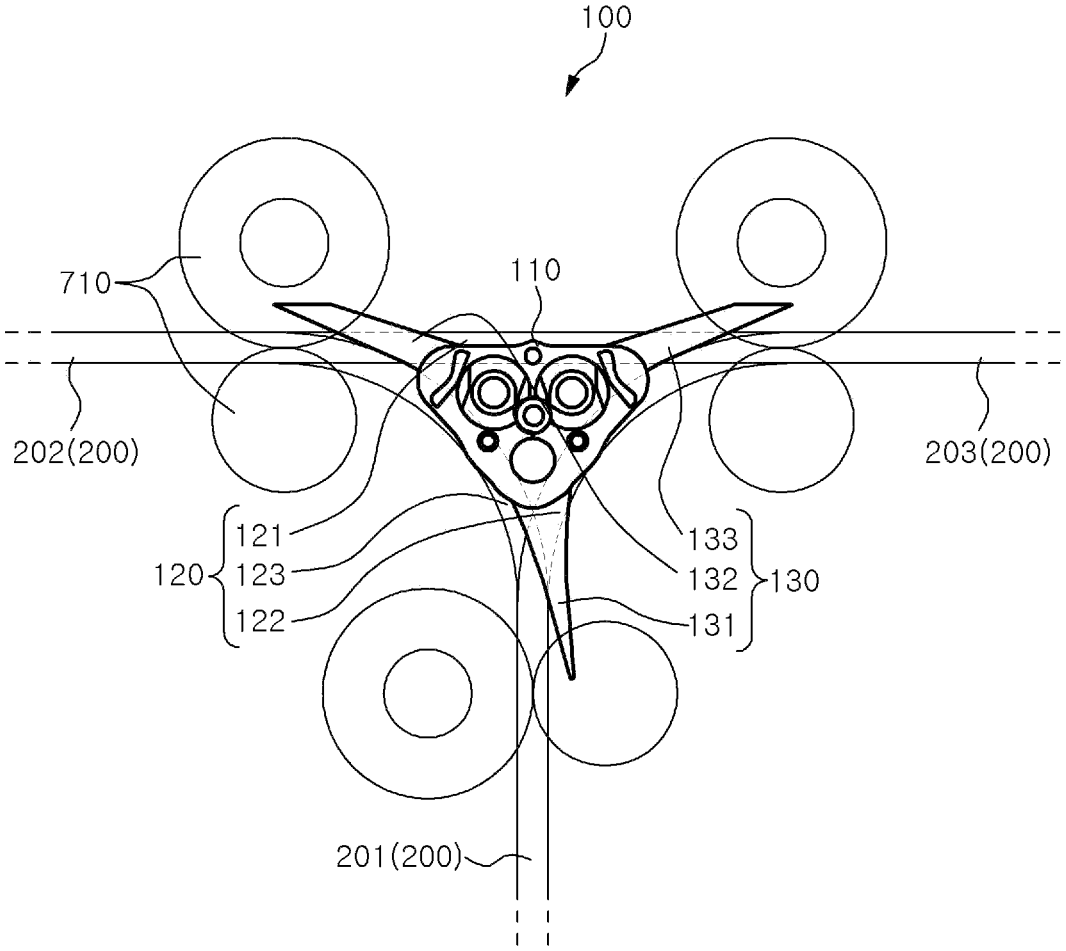
Figure 11:
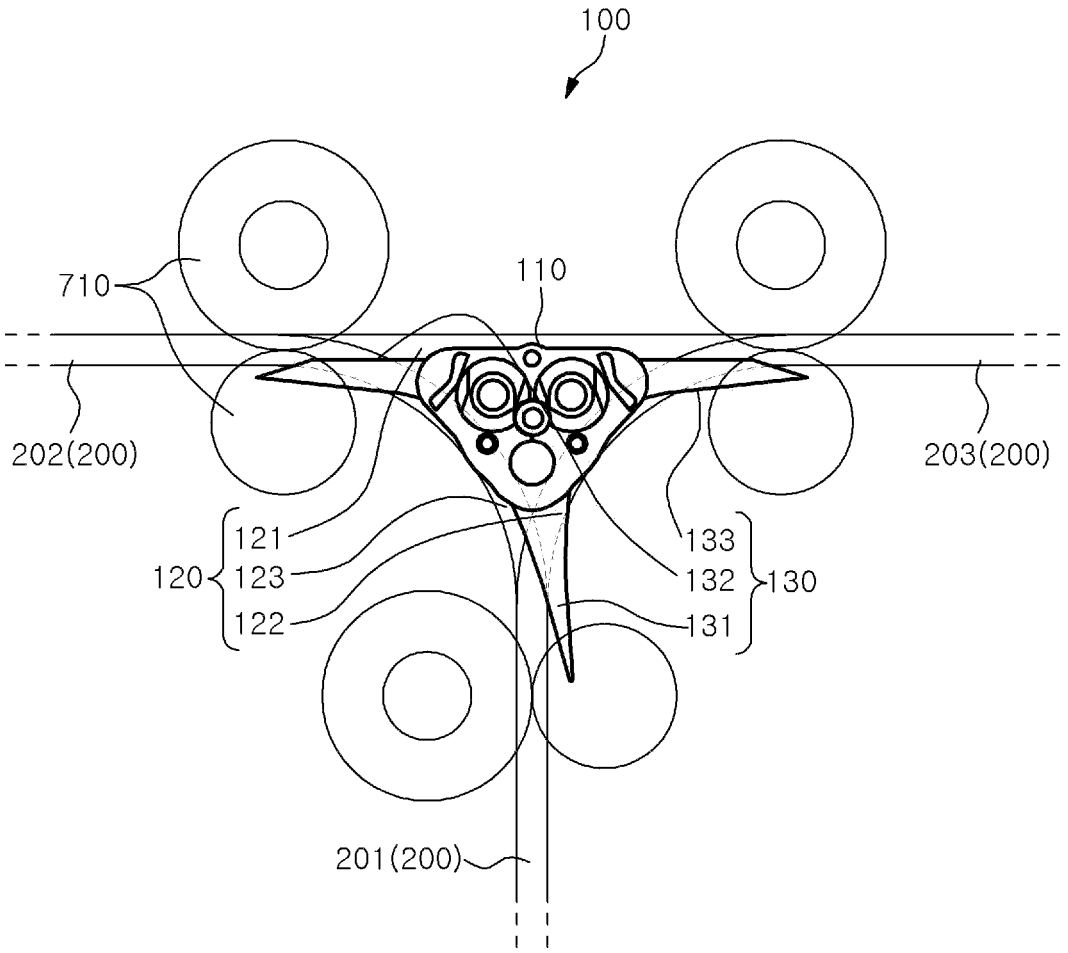

As shown in FIGS. 9 to 11, in order to guide the medium transferred from the conveyance path in one direction to the conveyance path in other directions, a plurality of switching paths 120 for branch may be provided in the conveyance path. For example, the plurality of switching paths 120 may include a first switching path 121, a second switching path 122, and a third switching path 123 interconnecting three-way conveyance paths.

The first switching path 121 may connect the second conveyance path 202 and the third conveyance path 203. The second switching path 122 may connect the first conveyance path 201 and the third conveyance path 203. The third switching path 123 may connect the first conveyance path 201 and the second conveyance path 202. In this case, the first conveyance path 201 may be branched into the second switching path 122 and the third switching path 123. The second conveyance path 202 may be branched into the first switching path 121 and the third switching path 123. The third conveyance path 203 may be branched into the first switching path 121 and the second switching path 122.

For example, as shown in FIG. 9, by the operation of the actuator, when the first rotary shaft 151 of FIG. 8 rotates clockwise in FIG. 9, the second rotary shaft 152 of FIG. 8 rotates clockwise in FIG. 9, and the third rotary shaft 153 of FIG. 8 rotates counterclockwise in FIG. 9, the first gate 131 rotates clockwise in FIG. 9, the second gate 132 rotates clockwise in FIG. 9, the third gate 133 rotates counterclockwise in FIG. 9, and the first gate 131 and the third gate 133 may open the second switching path 122.

Accordingly, the medium moved through the first conveyance path 201 is guided to the third conveyance path 203 through the second switching path 122, or the medium moved through the third conveyance path 203 may be guided to the first conveyance path 201 through the second switching path 122.

As shown in FIG. 10, when the first rotary shaft 151 of FIG. 9 rotates counterclockwise in FIG. 10 by the operation of the actuator, the first gate 131 rotates counterclockwise in FIG. 10, and the first gate 131 and the second gate 132 may open the third switching path 123.

Accordingly, the medium moved through the first conveyance path 201 is guided to the second conveyance path 202 through the third switching path 123, or the medium moved through the second conveyance path 202 may be guided to the first conveyance path 201 through the third switching path 123.

As shown in FIG. 11, by the operation of the actuator, when the third rotary shaft 153 of FIG. 10 rotates clockwise in FIG. 11, and the second rotary shaft 152 of FIG. 10 rotates counterclockwise in FIG. 11, the third gate 133 is rotated clockwise in FIG. 11, the second gate 132 rotates counterclockwise in FIG. 11, and the second gate 132 and the third gate 133 may open the first switching path 121.

Accordingly, the medium moved through the second conveyance path 202 is guided to the third conveyance path 203 through the first switching path 121, or the medium moved through the third conveyance path 203 may be guided to the second conveyance path 202 through the first switching path 121.

As described above, the conveyance path switching device according to the embodiments of the present disclosure has a structure that accurately and quickly changes the conveying direction of the medium when a medium is deposited/withdrawn, reduces the installation space of the actuator that drives the gate to realize space-intensive component arrangement in the device, increases the branching direction of the conveyance path in response to the diversified arrangement of the medium cassettes, and connects the three support pieces as one unit, which improves the assemblability of the conveyance path switching device.

In the above, the present disclosure has been described using preferred embodiments, but the scope of the present disclosure is not limited to the specific embodiments described. Those of ordinary skill in the art may freely substitute and change components within the scope of the present disclosure, and they also belong to the right of the present disclosure.

What is claimed is:

1. A medium conveyance path switching device of an automated teller machine, comprising:

a support unit located at a branch point of a conveyance path at which a conveying direction for a medium converges from three directions;

a gate assembly including a plurality of gates to guide the medium to different conveyance paths at the branch point; and a rotation mechanism configured to selectively rotate the plurality of gates, wherein the support unit includes:

a first support piece having a first through-hole portion;

a second support piece having a second through-hole portion and disposed on one side of the first support piece;

a third support piece having a third through-hole portion and disposed on the other side of the first support piece;

a first bending connection part pivotably connecting one end of the first support piece and the second support piece; and a second bending connection part pivotably connecting the other end of the first support piece and the third support piece, and wherein the first bending connection part has different thicknesses in a direction connecting the one end of the first support piece and the second support piece, and the second bending connection parts have different thicknesses in a direction connecting the other end of the first support piece and the third support piece.

2. The medium conveyance path switching device of claim 1, wherein the first bending connection part includes, on an inner surface thereof, a first main convex surface convexly rounded toward an inside direction of the first bending connection part, and a first sub-concave surface concavely recessed with respect to the inner surface of the first bending connection part, the first sub-concave surface continuously extending from the first main convex surface to inner surfaces of the first support piece and the second support piece, and wherein the inner surface of the second bending connection part includes, on an inner surface thereof, a second main convex surface convexly rounded toward an inside direction of the second bending connection part, and a second sub-concave surface concavely recessed with respect to the inner surface of the second bending connection part, the second sub-concave surface continuously extending from in the second main convex surface to the inner surface of the first support piece and an inner surface of the third support piece.

3. The medium conveyance path switching device of claim 1, wherein the first bending connection part includes, on an inner surface thereof, a first bending concave surface concavely recessed with respect to the inner surface of the first bending connection part and extending continuously to inner surfaces of the first support piece and the second support piece, and wherein the second bending connection part includes, on an inner surface thereof, a second bending concave surface concavely recessed with respect to the inner surface of the second bending connection part and extending continuously to the inner surface of the first support piece and an inner surface of the third support piece.

4. The medium conveyance path switching device of claim 1, wherein the plurality of gates include:

a first gate for guiding a conveying direction of the medium from a first conveyance path to a second conveyance path or a third conveyance path in the conveyance path;

a second gate for guiding a conveying direction of the medium from the second conveyance path to the first conveyance path or the third conveyance path; and a third gate for guiding a conveying direction of the medium from the third conveyance path to the first conveyance path or the second conveyance path.

5. The medium conveyance path switching device of claim 1, wherein at least one of the first bending connection part and the second bending connection part includes a flexible material.

* * * * *